US006398134B1

(12) United States Patent
Hickson et al.

(10) Patent No.: US 6,398,134 B1
(45) Date of Patent: Jun. 4, 2002

(54) TURRET MOUNTED NOZZLES FOR PRESSURE WASHER WAND

(75) Inventors: Ricky B. Hickson, Decatur; Jeffrey Willis, Rogers, both of AR (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/734,989

(22) Filed: Dec. 12, 2000

Related U.S. Application Data

(60) Provisional application No. 60/172,898, filed on Dec. 21, 1999.

(51) Int. Cl.[7] ..... A62C 31/02; B05B 1/32

(52) U.S. Cl. ..... 239/394; 239/390; 239/391; 239/392; 239/393; 239/538; 239/539

(58) Field of Search ..... 239/390, 391, 239/392, 393, 394, 397, 537, 538, 539, 540, 436, 442

(56) References Cited

U.S. PATENT DOCUMENTS

| | | | | |
|---|---|---|---|---|
| 2,148,535 A | | 2/1939 | Cone | 299/137 |
| 2,647,017 A | * | 7/1953 | Coulliette | 239/537 |
| 3,675,851 A | | 7/1972 | Merfeld et al. | 239/318 |
| 3,825,187 A | | 7/1974 | Tatge | 239/312 |
| 4,860,955 A | * | 8/1989 | Gill | 239/394 |
| 5,333,790 A | | 8/1994 | Christopher | 239/391 |
| 5,884,847 A | | 3/1999 | Christopher | 239/390 |
| 6,196,477 B1 | * | 3/2001 | Halltorp et al. | 239/537 |

* cited by examiner

*Primary Examiner*—Lesley D. Morris
*Assistant Examiner*—Davis Hwu
(74) *Attorney, Agent, or Firm*—MacMillan, Sobanski & Todd, LLC

(57) ABSTRACT

A turret assembly for mounting a plurality of spray nozzles on a pressure washer wand to facilitate changing the spray pattern. A female quick connect connector is mounted on the fluid discharge end of the wand to extend on an axis. Each nozzle is provided with a male connector adapted to be releasably locked in the female connector. The turret is mounted both for rotation on the wand about an axis and axial for movement. A spring urges the turret and nozzles away from the female connector. As the turret is rotated, the different nozzles can be moved into alignment with the female connector on the wand end. Once a selected nozzle is aligned with the female connector and the turret is moved against the spring force and the selected nozzle is releasably locked to the female connector. The nozzles can be quickly changed without risk of loss of the nozzles.

6 Claims, 3 Drawing Sheets

TURRET MOUNTED NOZZLES FOR PRESSURE WASHER WAND

CROSS-REFERENCE TO RELATED APPLICATIONS

Applicants claim priority to United States Provisional Patent Application Ser. No. 60/172,898 filed Dec. 21, 1999.

STATEMENT REGARDING FEDERALLY SPONSORED RESEARCH OR DEVELOPMENT

Not Applicable.

TECHNICAL FIELD

The invention relates to high pressure water pressure washers and more particularly to a turret nozzle assembly for use on a pressure washer wand.

BACKGROUND OF THE INVENTION

Pressure washers include a high pressure pump which has a water inlet adapted to be connected to a relatively low pressure water source, such as a garden hose connected to a water faucet, and a high pressure outlet which is connected through a hose to a wand. As used herein, the term "water" shall mean any pressurized fluid delivered to the wand. Generally, the fluid is water. However, chemicals such as cleaning solutions are sometimes mixed with the water. Typically, the pump will produce a maximum water pressure within the range of between 1,000 psig (70.3 Kg/cm$^2$) and 3,500 psig (246.1 Kg/cm$^2$). Lower water pressures are sometimes provided in lower cost pressure washers. However, lower water pressures generally have less cleaning ability. Higher water pressures also can be provided. At the higher pressures, care must be taken to not damage surfaces being sprayed.

The wand typically includes an open/closed water valve at an end which connects to the pressurized water hose and a water discharge nozzle at an opposite end. Different nozzle configurations are desirable for different applications. For example, it may be desirable to provide a highly concentrated high velocity stream of water for difficult cleaning operations, such as for removing rust scale or paint. For other applications, such as for cleaning an automobile, it may be desirable to provide a lower velocity fan shaped spray for rapidly cleaning larger areas and to prevent any risk of paint damage.

It is known that pressure washers wands may be provided with an adjustable nozzle. For example, a concentrated high pressure water spray pattern is provided in one nozzle setting. Alternately, a pair of opposing flat surfaces may be moved to contact opposite sides of the fluid spray immediately downstream from a round discharge orifice to flatten and disperse the spray into a fan shaped pattern. Alternately, it is known that different size and shape nozzles may be provided. A female quick connect connector may be mounted on the free end of the wand. The different spray nozzles may be provided with male quick connect connector for selectively attaching to the female connector on the wand. As the nozzle needs change, a nozzle can be quickly detached from the wand and replaced with a different nozzle. Although this works well, there can be a problem with keeping track of the different nozzles. It also is known, for example, as shown in Tatge U.S. Pat. No. 3,825,187 that a number of nozzles may be mounted on a turret which can be rotated to selectively align the different nozzles with the wand end. The turret does not necessarily provide precise alignment between the different nozzles and the end of the wand. Also, it is difficult to maintain a water tight seal between the selected nozzle and the high pressure water passage in the wand.

BRIEF SUMMARY OF THE INVENTION

According to the invention, a female quick connect connector having an axis is mounted on the end of a pressure washer wand for releasably attaching a fluid spray nozzle. A turret assembly including a number of spray nozzles is mounted on the wand. Each spray nozzle has an end formed into a male portion of a quick connect connector capable of being releasably locked to the female connector on the wand. The turret assembly is mounted so that the different nozzles may be rotated into axial alignment with the quick connect connector. The turret is spring biased to urge the nozzles axially away from the female connector so that the nozzles are spaced away from the female connector as the turret is rotated. After a selected nozzle is aligned with the female connector, the turret is moved in an axial direction against the spring force to seat the selected nozzle into the female connector. When a different nozzle is needed, the female connector is moved to release the male connector on the nozzle and the spring moves the turret away from the female connector. A different nozzle can then be rotated into alignment with the female connector and seated in the female connector. Thus, the nozzles which are not being used are retained on the turret at the wand end so that they cannot be misplaced.

Accordingly, it is an object of the invention to provide a turret mounted nozzle assembly for mounting on a pressure washer wand to permit rapid selection and connection of different nozzles to the wand for providing a desired spray pattern.

Other objects and advantages of the invention will become apparent from the following detailed description of the invention and the accompanying drawings.

DETAILED DESCRIPTION OF THE INVENTION

Figure 1:
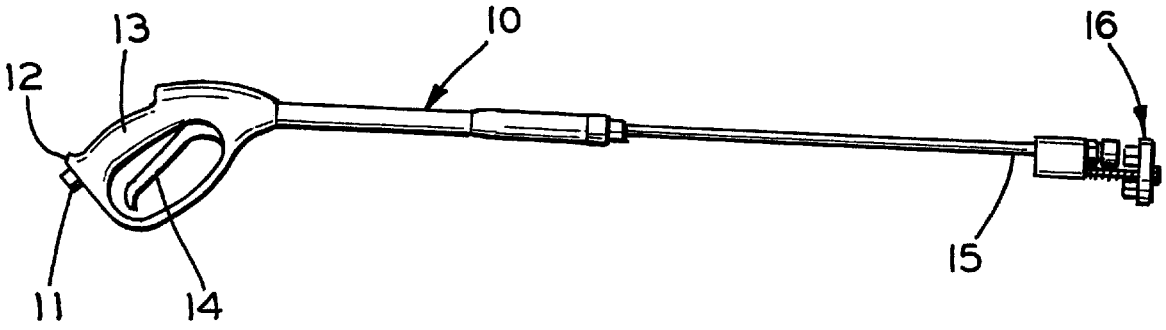
FIG. 1 is a side elevational view of a pressure washer wand with an attached nozzle turret assembly according to the invention.
Figure 2:
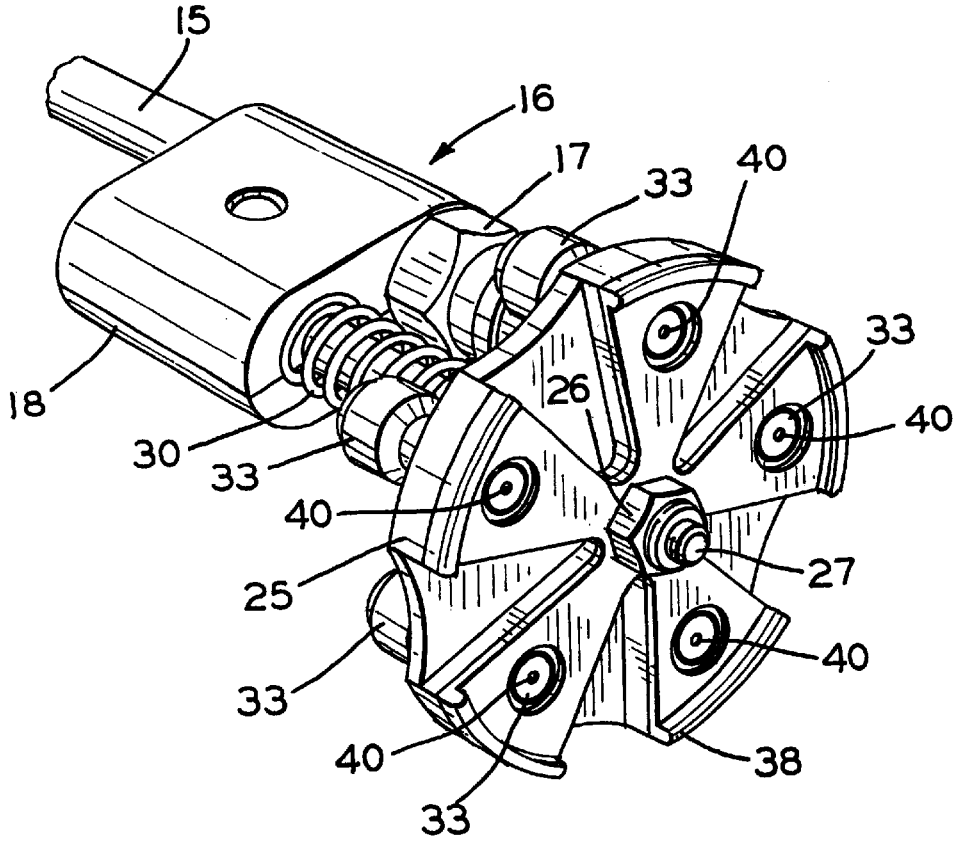
FIG. 2 is a is a perspective view of the nozzle turret assembly of FIG. 1.
Figure 3:
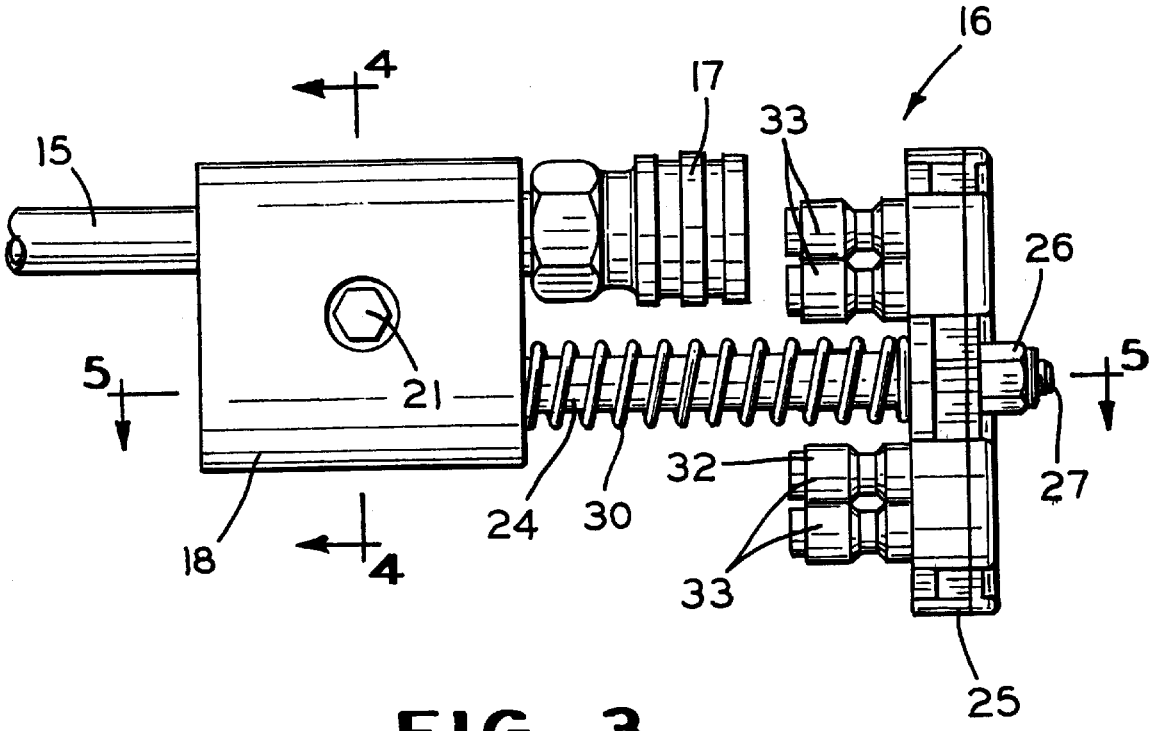
FIG. 3 is a side elevational view of the nozzle turret assembly, shown with no nozzle connected to the end of the wand.
Figure 4:
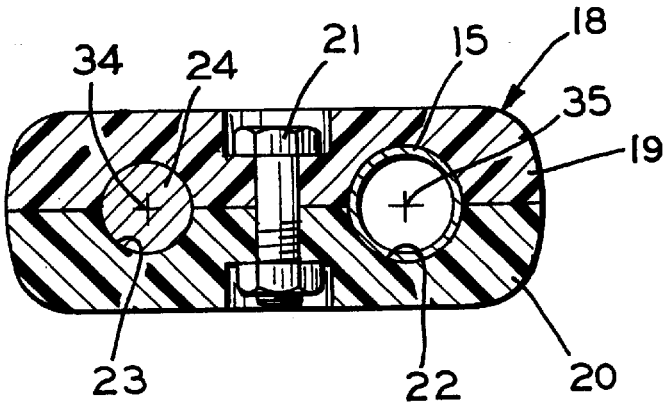
FIG. 4 is a cross sectional view as taken along line 4—4 of FIG. 3.
Figure 5:
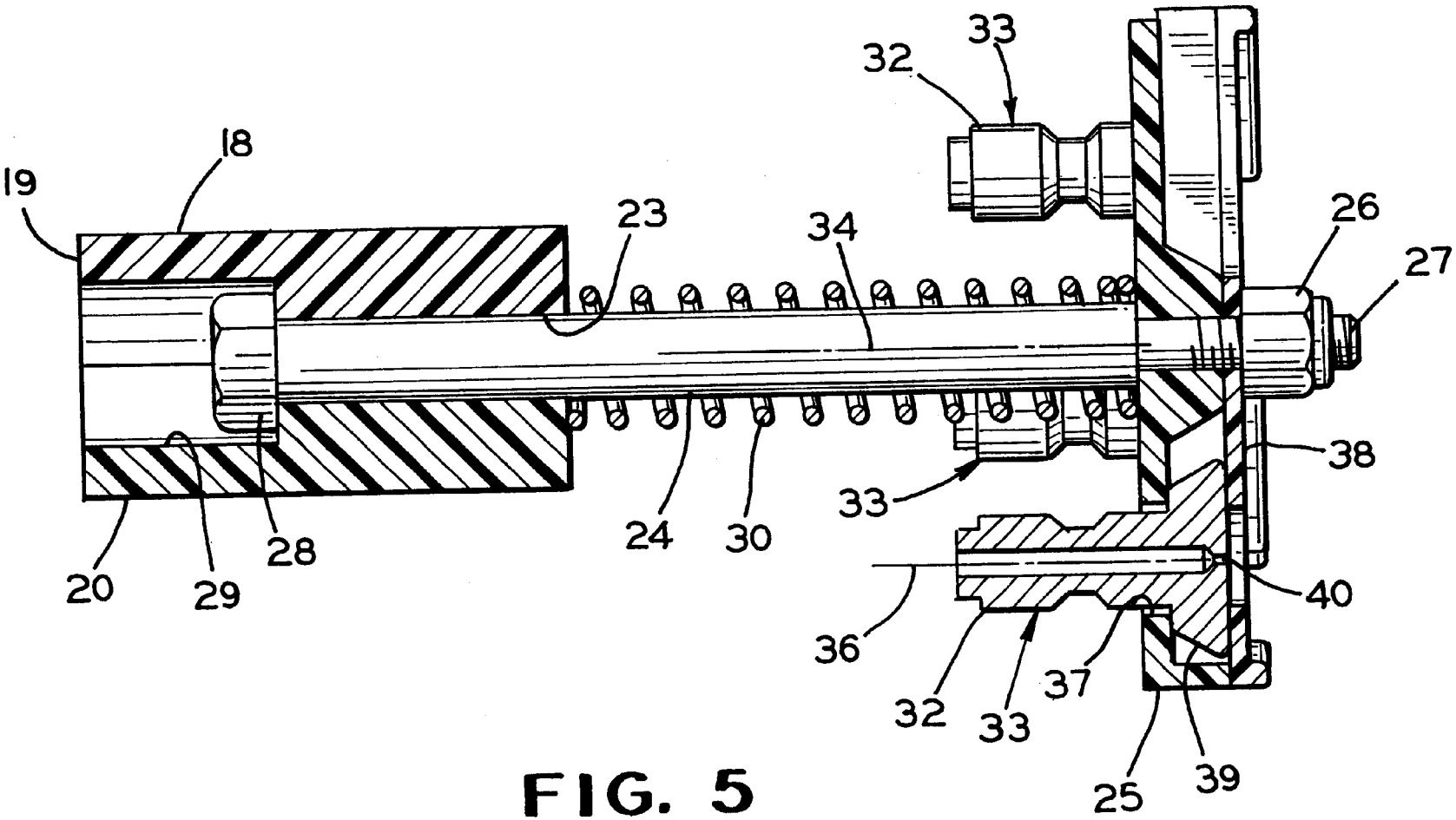
FIG. 5 is a cross sectional view as taken along line 5—5 of FIG. 3

Referring to the drawings, FIG. 1 shows a wand 10 having a fitting 11 at an end 12 for attaching to a high pressure water hose from a conventional pressure washer pump (not shown). It should be appreciated that the fitting 11 may be eliminated and the high pressure water hose may be permanently connected to the wand end 12. The wand 10 has a handle 13 adjacent the end 12 and has a trigger 14 for operating a conventional open/closed water flow control valve (not shown). The wand 10 has a free end 15 from which high pressure water is discharged in response to actuation of the trigger 14. The wand 10 from the end 12 to the end 15 may be of various commercially available designs and do not form a part of the invention. According to the invention a turret assembly 16 is mounted on the wand end 15.

FIGS. 2–5 show details of the nozzle turret assembly 16 and of its connection to the wand end 15. A commercially available female quick connect connector 17 is mounted on the wand end 15. The turret assembly 16 is secured to the wand 10 adjacent the end 15 with a clamp 18 in the form of two half shells 19 and 20 and a bolt 21 which secures the half shells 19 and 20 together. The shells 19 and 20 form two parallel holes 22 and 23 therebetween. The hole 22 receives and is tightly clamped to the wand 10 adjacent the end 15. The hole 23 receives a rod 24 which is free to slide in an axial direction and to rotate in the hole 23. A generally circular nozzle mounting plate 25 is secured with a nut 26 to a threaded end 27 of the rod 24.

The rod 24 is provided with a head 28 on an end opposite the threaded end 27. The head 28 is of a size which will not pass through the hole 23 in the clamp 18. Optionally, the hole 23 may have an enlarged end 29 which is sufficiently large to receive the head 28. A helical compression spring 30 is positioned coaxially over the rod 24 and is compressed between the clamp 18 and the nozzle mounting plate 25. The compression spring 30 urges the nozzle mounting plate 25 away from the clamp 18. However, the nozzle mounting plate 25 can be rotated and can be moved against the force of the spring 30 towards the clamp 18.

A plurality of different fluid nozzles 33 are mounted on the mounting plate 25 at equal radial spacing from the rod 24. The radial spacing of an axis 36 of each of the nozzles 33 from an axis 34 of the rod 24 is the same as the spacing between the axis 34 of the rod 24 and an axis 35 of the female quick connect connector 17 and the wand end 15. Consequently, the mounting plate 25 may be rotated to align a selected nozzle 23 with the quick connect connector 17.

Each nozzle 23 has a rear end 32 which projects through an opening 37 the nozzle mounting plate 25. Preferably, the openings 37 are slightly larger than the diameters of the portion of the nozzle 33 in the opening 37. This permits slight lateral movement of each nozzle 33 within its opening 33 to facilitate alignment with the female connector 17 and to compensate for normal manufacturing tolerance variations. A cover 38 is clamped between the nozzle mounting plate 25 and the nut 26. Each nozzle 33 has a forward portion 39 which is larger in diameter than the cover plate openings 37. The cover 38 retains the nozzles 33 on the nozzle mounting plate 25. Preferably, the cover retains each nozzles 33 on the mounting plate 25 without prohibiting limited lateral movement in an opening 37 so that the axis 36 of a selected nozzle 33 can self align with the axis 35 of the female quick connect connector 17. The nozzle mounting plate 25 and the cover 38 form a turret which mounts the nozzles 33 and is capable both of rotating about and of moving along the axis 34.

The rear end 32 of each nozzle 33 is in the form of a male quick connect connector which is adapted to be releasably locked into and to seal to the female quick connect connector 17. Various female quick connect connectors 17 are commercially available. The configurations of the rear ends 32 of the nozzles 33 will depend on the type of quick connect connector 17 mounted on the wand end 15.

Each of the different nozzles 33 may have a different size or shape fluid discharge orifice 40 for producing a different spray pattern. The orifices 40 may be formed as an integral portion of each nozzle 33, or may be in replaceable inserts threaded into the nozzles 33. The different nozzles may create, for example, streams, conical spray patterns and fan shaped spray patterns.

In operation, a nozzle 33 which will provide a desired spray pattern is selected and the mounting plate 25 is rotated to substantially align the axis 36 of the selected nozzle 33 with the axis 35 of the quick connect connector 17 on the wand end 15. The nozzle mounting plate 25 is then pushed towards the clamp 18 and at the same time the female quick connect connector 17 is manually operated to receive the rear end 32 of the selected nozzle 33. The female quick connect connector 17 is then released to lock onto and to seal to the selected nozzle 33. Thus, a strong, leak free connection is made between the selected nozzle 33 and the wand end 15. This connection will withstand the high water pressure during operation without placing any force on the turret assembly 16. When a different spray pattern is required, it only requires releasing the nozzle 23 from the quick connect connector 17, rotating the mounting plate 25 to select the nozzle 33 which produces the desired spray pattern, and attaching the selected nozzle 33 to the quick connect connector 17.

It will be appreciated that various modifications and changes may be made to the above described preferred embodiment of a pressure washer wand with turret mounted nozzles without departing from the scope of the following claims. For example, it should be appreciated that the spring 30 may be eliminated and that the nozzle mounting plate 25 may be manually moved both towards and away from the clamp 18 when attaching and detaching a nozzle 33 from the female connector 17. It also should be appreciated that other techniques can be used for mounting the individual nozzles 33 on the turret and for securing the turret to the wand. Preferably, the technique used for mounting the individual nozzles 33 should permit easy replacement of any worn nozzle.

What is claimed is:

1. A nozzle assembly for attachment to a pressure washer wand having a female quick connect connector attached to a fluid discharge end of the wand, the female quick connect connector having an axis, said nozzle assembly comprising a turret adapted to be mounted on the wand for rotation about a turret axis and for axial movement along said turret axis and herein said turret axis is substantially parallel to and a predetermined spacing from the female quick connect connector axis, a plurality of nozzles mounted on said turret, each of said nozzles having an axis spaced from said turret axis by substantially said predetermined spacing, each of said nozzles further having a fluid discharge orifice for discharging pressurized fluid in a predetermined spray pattern and having a male connector end adapted to be releasably locked to the female quick connect connector, whereby a selected nozzle may be rotated into axial alignment with and moved axially into engagement with the female quick connect connector.

2. A nozzle assembly for attachment to a pressure washer wand, as set forth in claim 1, and wherein each of said nozzles is mounted on said turret for limited lateral movement to facilitate alignment of the axis of a selected nozzle with the axis of a female quick connect connector on a wand.

3. A nozzle assembly for attachment to a pressure washer wand, as set forth in claim 1, and further including a clamp adapted to be clamped to a wand adjacent a female quick connect connector on a wand end, said clamp having an opening, a rod mounted to both rotate and move in an axial direction in said clamp opening, said rod extending along said turret axis, and wherein said rod has an enlarged first end which will not pass through said clamp opening and has a second end secured to said turret.

4. A nozzle assembly for attachment to a pressure washer wand, as set forth in claim 3, and further including a helical compression spring positioned around said rod to extend between said clamp and said turret, said spring urging said turret away from said clamp.

5. A nozzle assembly for attachment to a pressure washer wand, as set forth in claim 4, and wherein said turret includes a nozzle mounting plate and a cover, said nozzle mounting plate having a plurality of nozzle openings each sized for passing the male connector end of a nozzle, and wherein each nozzle has a section which will not pass through said nozzle openings which is retained between said nozzle mounting plate and said cover.

6. A nozzle assembly for attachment to a pressure washer wand, as set forth in claim 5, and wherein each of said nozzles is unrestrained limited lateral movement in a nozzle opening in said nozzle mounting plate to facilitate alignment of the axis of a selected nozzle with the axis of a female quick connect connector on a wand.

* * * * *